US009179745B2

(12) United States Patent
Berland

(10) Patent No.: US 9,179,745 B2
(45) Date of Patent: Nov. 10, 2015

(54) AWESUMBRELLA

(76) Inventor: Stacey L. Berland, Poquoson, VA (US)

( * ) Notice: Subject to any disclaimer, the term of this patent is extended or adjusted under 35 U.S.C. 154(b) by 0 days.

(21) Appl. No.: 13/437,879

(22) Filed: Apr. 2, 2012

(65) Prior Publication Data

US 2013/0092199 A1 Apr. 18, 2013

Related U.S. Application Data

(60) Provisional application No. 61/574,057, filed on Jul. 27, 2011.

(51) Int. Cl.

| | |
|---|---|
| ***A45B 3/00*** | (2006.01) |
| ***A45B 23/00*** | (2006.01) |
| ***A45B 25/00*** | (2006.01) |
| ***E04H 12/22*** | (2006.01) |

(52) U.S. Cl.

CPC . *A45B 3/00* (2013.01); *A45B 25/00* (2013.01); *E04H 12/2223* (2013.01); *A45B 2023/0012* (2013.01); *A45B 2200/1009* (2013.01); *A45B 2200/1063* (2013.01); *E04H 12/2238* (2013.01); *E04H 12/2276* (2013.01)

(58) Field of Classification Search

CPC ..... A45B 2023/0012; A45B 2200/1109; E04H 12/2223

USPC ..... 135/16, 20.3, 25.4; 52/157; 173/90; 175/101, 102, 394

See application file for complete search history.

(56) References Cited

U.S. PATENT DOCUMENTS

| | | | | |
|---|---|---|---|---|
| 1,284,569 | A * | 11/1918 | Bikowski | 52/157 |
| 2,449,313 | A * | 9/1948 | Naef | 174/6 |
| 5,152,495 | A * | 10/1992 | Jacinto et al. | 248/545 |
| 6,085,766 | A * | 7/2000 | Geary | 135/75 |
| 6,210,077 | B1 * | 4/2001 | Kondo | 405/244 |
| 6,487,977 | B1 | 12/2002 | Williams et al. | |
| 6,547,203 | B1 | 4/2003 | Willard | |
| 7,246,783 | B2 * | 7/2007 | Harold et al. | 248/545 |
| 7,497,225 | B1 * | 3/2009 | Klein et al. | 135/16 |
| 7,503,541 | B2 * | 3/2009 | Harold et al. | 248/545 |
| 7,581,707 | B2 | 9/2009 | Saraf | |
| D630,834 | S | 1/2011 | Cohen | |
| 2005/0211282 | A1 * | 9/2005 | DeVenezia et al. | 135/16 |
| 2007/0246091 | A1 * | 10/2007 | Becker | 135/16 |
| 2008/0092936 | A1 * | 4/2008 | Carabillo | 135/16 |
| 2008/0099061 | A1 * | 5/2008 | McKnight | 135/118 |

* cited by examiner

*Primary Examiner* — David R Dunn
*Assistant Examiner* — Danielle Jackson
(74) *Attorney, Agent, or Firm* — Duncan G. Byers; Pender & Coward P.C.

(57) ABSTRACT

An improved self-anchoring umbrella, the umbrella comprising a canopy and pole, a retractable auger disposed within the pole of the umbrella. The retractable auger is operated using an electric motor and portable power source, and a switch allowing a user to provide power to the electric motor which rotates a drive head with spiral teeth engaged within spiral grooves in the pole. The umbrella may further include a table portion, and extendable stabilizing legs disposed in the lower portion of the pole. When the auger portion is screwed into sand or other surface and the stabilizing legs are engaged with the surface, the invention provides a stable umbrella for outdoor recreation and other purposes.

14 Claims, 3 Drawing Sheets

AWESUMBRELLA

BACKGROUND OF THE INVENTION

The present invention relates to beach umbrellas, and more particularly to beach umbrellas that provide, in combination with the typical umbrella configuration, self-contained auger mechanisms and power supplies to secure and stabilize the beach umbrella when in use.

SUMMARY OF THE INVENTION

Beach umbrellas are common and desirable for protection from the sun. In recent years, beach umbrellas have come to refer to a wide assortment of umbrella designs that have a common set of characteristics: they are portable but large enough both in height and width of the umbrella that it may be used to cover a group of people. Generally, beach umbrellas tend to be from 5 feet to 7 feet wide when opened, although there are some that are larger and some smaller, specialized umbrellas that are in the "beach umbrella" style. Beach umbrellas, despite the name, are also used in a wide variety of outdoor applications. These may include cookouts, concerts and other events, picnics, camping, etc.

However, beach umbrellas can also be inherently unstable. Usually, a beach umbrella is secured in place by pushing the end of its pole into the sand or ground where the umbrella is desired to be positioned. However, sand may be loose or the ground may be too hard to provide a secure position for the umbrella. Also, because beach umbrellas are designed to be as large as possible yet still be "portable," beach umbrellas tend to be inherently awkward to install. They are designed to provide as much cover as possible, so that they are usually at the upper size limit for one person to handle and secure in the sand or ground.

In addition, there may be a need to move the umbrella during the course of a day, causing the user to have to remove the pole from the sand or ground, and re-sinking the pole to try and secure the umbrella once again. In some locations wet, heavy sand may also make securing the pole difficult. This is especially true for smaller people, children, the elderly, and the handicapped. What is needed, therefore, is a means to assist a user in securing a beach umbrella in the sand or ground.

Several modifications to existing beach umbrellas have been designed in attempts to deal with these issues.

U.S. Design Pat. No. D630,834, ANCHOR AUGER FOR BEACH UMBRELLA issued Jan. 18, 2011 to Cohen teaches an ornamental design for an anchor auger for beach umbrellas. There are, however, obvious drawbacks to this design. First and foremost, the '834 design is physically separate from the umbrella that a user would wish to anchor. This creates additional burdens for the user, among them simply keeping track of two—rather than a single—pieces of equipment. And, because the most important piece of equipment is the umbrella itself, the one most likely to be forgotten is the Anchor Auger when leaving the home for an outdoor event. In addition, the auger portion of the invention remains exposed at all times, creating the possibility of injuring either a person or property with the auger portion.

U.S. Pat. No. 7,581,707, AUTOMATIC UNIVERSAL MULTI-PURPOSE GROUND STAND issued Sep. 1, 2009 to Saraf teaches an automatic ground stand that can be attached to an umbrella "or any like device." The '707 invention, however, has numerous drawbacks. First, as with the '834 invention of Cohen, the '707 invention is a piece of equipment separate and apart from the umbrella and therefore must be maintained separately and remembered each time the umbrella is used outdoors. Second, only the auger itself rests in the ground and no part of the umbrella pole. Because the umbrella attaches at the top of the '707 device and could create unwanted motion in the device above the level of the ground, the device could work back and forth and loosen the device from the ground or cause it to fall over completely. In addition, the auger has only two possible positions: fully retracted or fully extended. As a result, the '707 device cannot accommodate locations where optimal—or even attainable—auger depth is less than the length of the auger at full extension. In that situation, the device will only have a portion of the auger inside the ground, creating an inherently unstable platform to hold a tall, heavy, and awkward beach umbrella.

U.S. Pat. No. 7,503,541, BEACH UMBRELLA STAND INCLUDING FOTT OPERATED DRIVE ASSEMBLY FOR ANCHORING AND METHOD OF USE, issued Mar. 17, 2009 to Harold and Sperry teaches a beach umbrella stand with a foot operated drive assembly. This design has deficiencies similar to the '834 patent in that the auger portion remains exposed permanently; the auger cannot be either extended or retracted. This serves to not only extend the length of the pole of an already long beach umbrella, it leaves the auger exposed to damage as well as exposing people and property to damage from the exposed auger. In addition, the auger must be manually operated, and requires an additional (easily lost) foot pedal.

U.S. Pat. No. 6,547,203, RETRACTABLE ANCHORING DEVICE, issued Apr. 15, 2003 to Willard teaches a retractable anchoring device with a hollow tubular member to support a "shade providing device." While this device provides for a retractable auger, it has several drawbacks. First among them is that, like with other prior art discussed herein, it is a device separate and apart from the umbrella or other item that it is used to anchor. It is thereby difficult to keep track of and easily lost or forgotten when a user takes an umbrella to a beach or other location. In addition, the auger portion has only two positions: either fully extended or fully retracted. This will lead to a situation where, because of the density of the ground or because of obstructions (such as rocks) the auger may only be partially driven into the ground. This leads to inherent instability in the design, making it undesirable in many circumstances.

U.S. Pat. No. 6,487,977, BEACH/OUTDOOR TABLE WITH CORK SCREW ANCHOR AND UMBRELLA, issued Dec. 3, 2002 to Williams and Smith teaches an outdoor table with an umbrella and a base pole with a manually-operated auger. This device, however, requires manual operation of the auger which may be undesirable. Further, the auger portion is not retractable, which leads to the same problems noted above wherein the exposed auger can hurt people or property, is itself exposed to potential harm, and is inherently unstable in most circumstances where it cannot be driven completely into the ground. In addition, the device teaches a pair of rods extending horizontally from the pole that take up space desired to be used by people. The poles may get in the way of use and, in those situations where the device cannot be driven completely into the ground, will be exposed above the surface of the ground and may cause harm to individuals, especially children. Finally, manually attempting to drive the auger portion into the ground and get the poles to rest on the surface of the ground would be, at best, awkward. Once the poles get close to ground level, it is not possible to grip the poles and a user will then have limited ability to apply torque to the device at the time when the final and possibly most torque is needed.

What is needed, therefore, is:

An auger mechanism that does not increase the length of a beach umbrella.

An auger mechanism that is retractable.

An auger mechanism that is electro-mechanically operated.

An auger mechanism that can be utilized at various depths and still provide a stable umbrella base wherein the base of the umbrella pole rests directly on the surface of the ground; and An auger mechanism that is integral to a beach umbrella such that the use of the auger for anchoring the umbrella does not require any additional parts to be stored and them remembered when a user wishes to utilize a beach umbrella.

SUMMARY OF THE INVENTION

It is an object of the present invention to provide for a new, improved beach umbrella that incorporates a self-guiding auger mechanism.

It is a further object of the present invention to provide an improved beach umbrella with a self-guiding auger mechanism and a rechargeable power supply and motor incorporated within the umbrella pole.

DESCRIPTION OF THE DRAWINGS

FIG. 3(*b*) is a top-down view of a motor disposed within the inner portion of an umbrella pole in accordance with an embodiment of the present invention.

DESCRIPTION OF A PREFERRED EMBODIMENT

Figure 1:
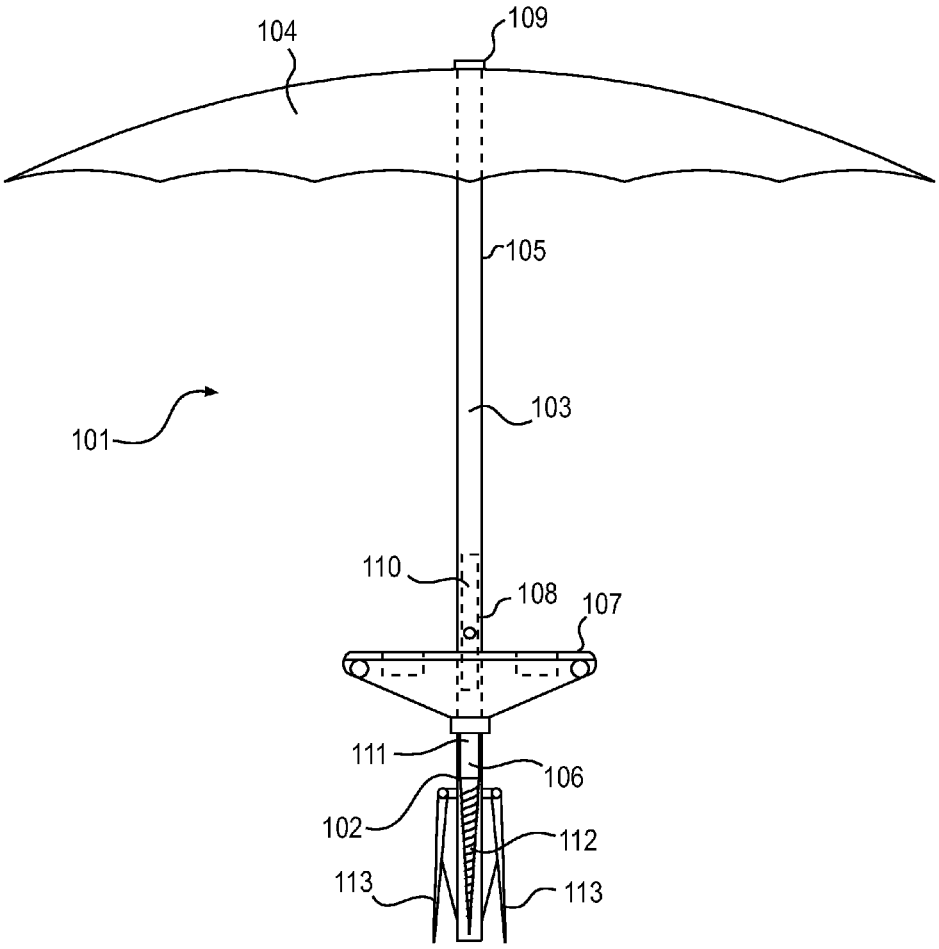
FIG. 1 is a view of an embodiment of the present invention.

Referring now to FIG. 1, an embodiment of the current invention is shown. The beach umbrella 101 comprises a bottom portion 102, a pole 103, and a canopy 104. The pole 103 is comprised of two portions; an upper portion 105 and a lower portion 106. The upper portion 105 connects to the canopy 104 at the center of the canopy 104. In a preferred embodiment, the beach umbrella further comprises a table 107. The upper portion 105 and the lower portion 106 connect mechanically with the upper portion 105 having a hollow lower part that slides over the top of the lower portion 106. The top of the lower portion 106 is of narrower diameter than the inside diameter of the hollow lower part of the upper portion 105, thereby allowing the upper end of the lower portion 106 to slide into the bottom end of the upper portion 105. Preferentially, the diameter of the top of the lower portion 106 is just narrow enough to slide snugly within the inside of the bottom of the upper portion 105. In a preferred embodiment, the upper portion 105 and the lower portion 106, once connected, are locked together using a locking pin 108. The locking pin may be inserted through corresponding holes in the upper and lower portions. The locking pin 108 may be spring loaded so as to be easier to use and to lock more securely. In the embodiment with a spring loaded locking pin 108, the locking pin is mounted in the lower portion 106, and is compressed as the upper portion 105 slides over the lower portion 106 to then extend outward through a corresponding hole in the upper portion 105 as the hole aligns with the locking pin.

In a preferred embodiment, the upper portion 105 and the lower portion 106 connect together just above the table 107. The table 107 may be of various sizes and shapes, and may include recesses for drinking cups and the like. Although the table is shown as being attached to the lower portion 106, it will be understood that the table may be attached to the upper portion 105 and still fall within the scope of the present invention.

The canopy 104 is well known in the art. The present invention can make use of any canopy design that is appropriate for a given application. In addition, mechanisms to open and close the canopies of umbrellas are well known in the art. In a preferred embodiment, for example, a moveable sleeve (not shown) of either plastic or metal is designed to fit around the upper portion 105. In the normal umbrella configuration, the sleeve is mechanically connected to the canopy mechanism such that moving the sleeve up or down on the pole will cause the canopy to open or close, and may further utilize a locking mechanism. It is commonly known in the art to use a spring-loaded snap buttons on an inner pole that may be recessed or pushed in by a user, and that snaps out to fit within holes or recesses in an outer pole to secure an extendable pole assembly to a desired length. This is merely an example of a common operating and locking mechanism for an extendable pole assembly and/or an umbrella assembly. Other means of opening, closing and locking the pole portion of the umbrella canopy, as well as opening, closing and locking the canopy portion may be utilized without deviating from the scope of the present invention. The upper portion 105 connects to the canopy 104, and may comprise a protective cap 109 of either metal or plastic.

The lower portion 106 further has a compartment located within the tube, the compartment being storage for a battery pack 110. The lower portion 106 also includes, located in the interior portion, a drive mechanism 111. The drive mechanism 111 is preferably an electric motor that is rotatably affixed to an auger bit 112 (shown recessed within the lower portion 106). An embodiment of the invention may further comprise telescoping legs 113 (shown unextended), which are hingedly attached to the lower portion 106 and may be extended from the lower portion 106 to rest on or within the ground creating greater stability for the device. The design of such telescoping legs 113 is well known in the art, and while the usual number of legs is three, it will be understood that there may by one or more telescoping legs 113 hingedly attached to the lower portion 106 that may be hingedly attached by means well known in the art without deviating from the scope of the present invention.

Figure 2:
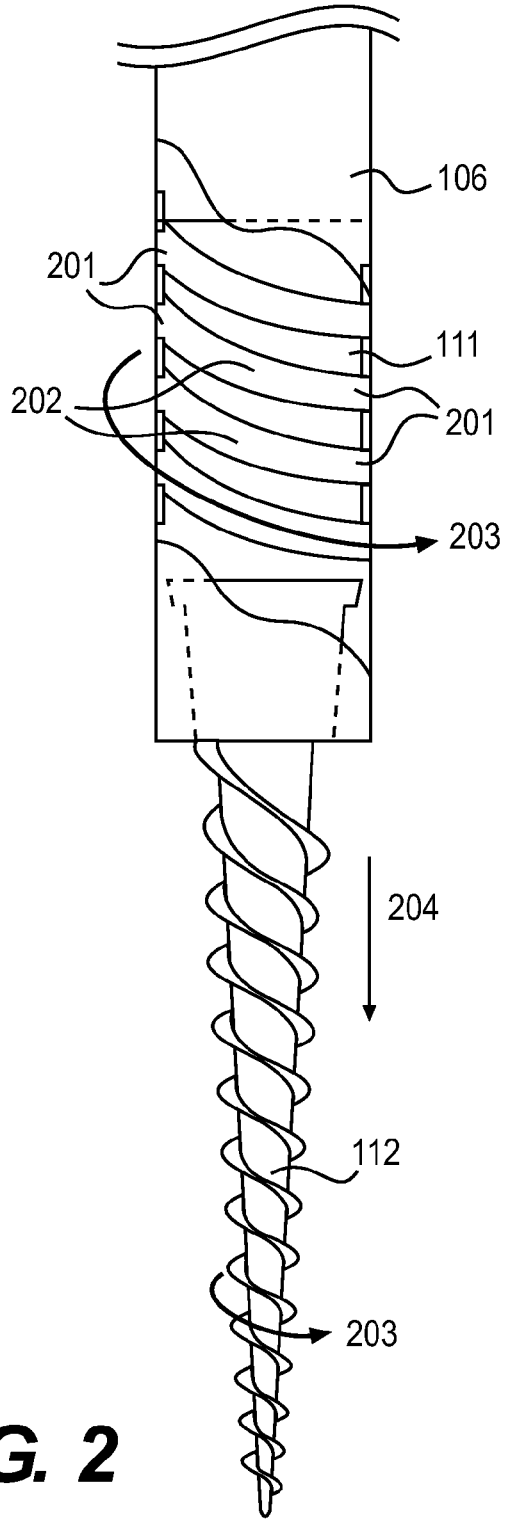
FIG. 2 is a view of an embodiment of the present invention.

Referring now to FIG. 2, a detail of an embodiment of the auger bit 112 assembly of the present invention is shown. The auger bit 112 is attached to a drive mechanism 111. The drive mechanism 111 is, in this embodiment, an electrical motor that is disposed within spiral grooves 201 that are formed in the interior wall of the lower portion 106. The spiral grooves 201 correspond to raised spiral teeth 202 that are on the outer surface of the drive mechanism 111. As the drive mechanism engages and rotates in the direction 203, the auger bit 112 rotates in the same direction 203, and the drive mechanism 111 and the auger bit 112 move in the downward direction 204, allowing the auger bit 112 to dig into the ground.

Figure 3A:
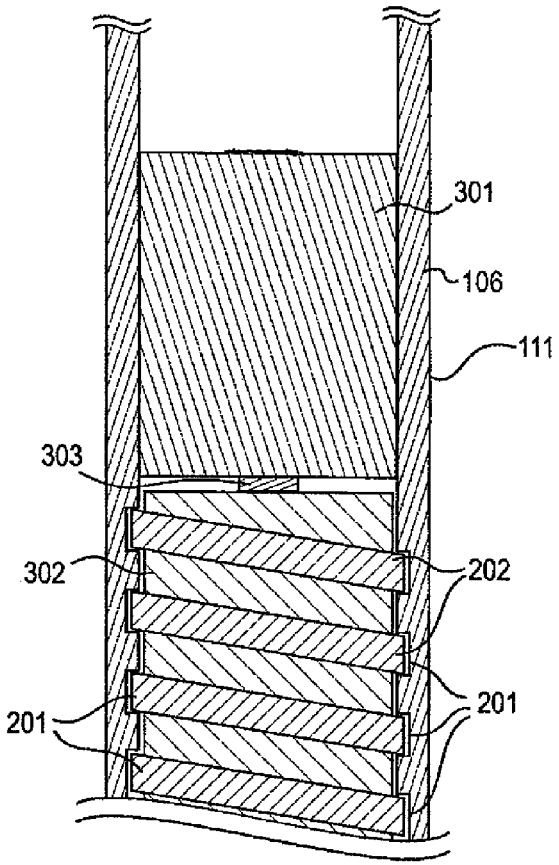
FIG. 3(*a*) is a cross-sectional view of an auger drive mechanism in accordance with an embodiment of the present invention.
Figure 3B:
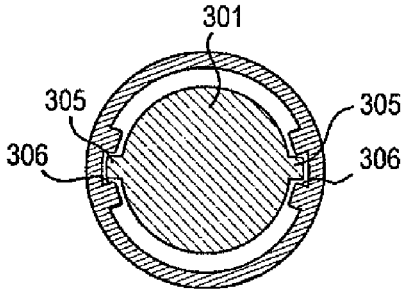

Referring now to FIG. 3(*a*), a cross-section of the lower portion 106 with a detail of the drive mechanism 111. The drive mechanism 111 comprises a motor 301 and a drive head 302, with the drive head 302 mechanically connected to the shaft 303 of the motor 301. The motor 301 is electrically connected to an electrical source and switching means for turning the motor on and off, as well as reversing the rotation of the motor 301. Such electrical sources and switching means are well known in the industry. The electrical source may be chosen from rechargeable and non-rechargeable batteries, solar panels, or other portable power sources. The switching means may be chosen from a toggle switch disposed within the outer wall of the lower portion 106 or the upper portion FIG. 1, 105, or from a pressure or rotational switch disposed within the junction of the table 107 and the upper portion 105. Choosing to utilize a portable power source and/or a switching means that is well known in the art will not cause a deviation from the scope and intent of the present invention. While other means are available and known in the art, in a preferred embodiment the rotational direction of the motor 301 is changed by changing the polarity of the electrical power connected to the motor 301.

The drive head 302 has raised spiral teeth 202 that engage the spiral grooves 201 that are formed within the inner wall of the lower portion 106. As the motor 301 is energized from a power source, the rotation of the shaft 303 causes rotation of the drive head 302, which rotates and moves vertically with respect to the lower portion 106, causing the auger bit FIG. 2, 112 to rotate and extend out of the lower portion 106 or rotate and be withdrawn into the lower portion 106, depending upon the rotation of the shaft 303. As shown in FIG. 3(*b*), The motor 301, in a preferred embodiment, has raised portions 305 that are disposed within grooves 306 formed within the inner wall of the lower portion 106, the grooves 306 running vertically within the inner wall of the lower portion 106, such that the motor 301, when energized, is held stationary about the rotational axis of the shaft 303, but may move vertically within the lower portion 106 as the drive head 302 rotates and moves up and down within the lower portion 105.

It will be understood that, while the invention is described in detail herein, embodiments exist which are not described herein but which are covered by and fall within the spirit and the scope of the invention as described.

What is claimed:

1. A beach umbrella comprising: a canopy;

a pole comprised of two portions, the two portions being an upper portion and a lower portion, the upper portion connected to the canopy, and the upper portion and lower portion further having interior walls;

the lower portion further has a compartment located within the lower portion, the compartment being storage for a battery pack, and the lower portion further comprises a drive mechanism that is rotatably affixed to an auger bit, and the auger bit being rotated by operation of the drive mechanism, the rotation of the auger bit causing the auger bit to extend out of the lower portion of the beach umbrella.

2. The beach umbrella of claim 1 wherein the drive mechanism further comprises an electric motor, and a drive head mechanically connected to the electric motor, wherein the electric motor is electrically connected through an operating switch to the battery pack and wherein the electric motor is electrically reversible through operation of the operating switch.

3. The beach umbrella of claim 2 wherein the auger bit is attached to the drive head and the drive head is disposed within spiral grooves that are formed in the interior wall of the lower portion, the spiral grooves corresponding to raised spiral teeth disposed on the drive head, and as the drive mechanism engages and rotates, the auger bit rotates in the same direction as the rotation of the drive mechanism, and the drive mechanism and the auger bit move in the downward direction.

4. The beach umbrella of claim 3 wherein the operating switch-provides means for turning the motor on and off, as well as reversing the rotation of the motor.

5. The beach umbrella of claim 4 and where, as the motor is energized from the battery pack, the rotation of the electrical motor causes rotation of the drive head, which rotates, causing the raised spiral teeth to move within the spiral grooves, causing the drive head and the auger bit to rotate and extend out of the lower portion or, upon reversal of the electric motor, rotate and be withdrawn into the lower portion.

6. The beach umbrella of claim 5 wherein the electric motor further comprises raised portions that are disposed within vertical grooves formed within the interior wall of the lower portion such that the electric motor, when energized, may move vertically within the lower portion as the drive head rotates and moves up and down within the lower portion.

7. The beach umbrella of claim 1 wherein the upper portion further comprises a hollow bottom end and the lower portion further comprises a top part that is narrower than the inside diameter of the hollow bottom end of the upper portion, the hollow bottom end connecting the upper portion to the lower portion by the hollow bottom end sliding over the top part of the lower portion.

8. The beach umbrella of claim 7 wherein the upper portion and the lower portion each further comprise corresponding holes that will create a communicative opening straight through the upper portion and the lower portion once the upper portion and the lower portion are connected, and wherein the upper portion and the lower portion, once connected, are locked together using a locking pin wherein the locking pin inserts through the corresponding holes in the upper portion and the lower portion.

9. The beach umbrella of claim 8 wherein the locking pin is a spring-loaded locking pin that is mechanically mounted on the lower portion, and is compressed as the upper portion slides over the lower portion to then extend outward through a corresponding hole in the upper portion as the hole aligns with the locking pin.

10. The beach umbrella of claim 1 wherein the canopy may be mechanically raised and lowered.

11. The beach umbrella of claim 1 further comprising telescoping legs which are hingedly attached to the lower portion and may be extended from the lower portion to rest on or within the ground.

12. A beach umbrella comprising:

a canopy;

a lower portion and an upper portion, the upper portion and lower portion further having interior walls;

a battery pack;

the lower portion has a compartment located within the lower portion, the compartment being storage for the battery pack; and the lower portion further comprising a drive mechanism and an auger bit; wherein the drive mechanism comprises an operating switch, an electric motor electrically connected to the battery pack through the operating switch, the electrical motor having a shaft, a drive head mechanically connected to the shaft of the electric motor, the electric motor being electrically reversible through operation of the operating switch, and the auger bit mechanically attached to the drive head; wherein the electric motor further comprises raised portions that are disposed within vertical grooves disposed within the lower portion such that the electric motor, when energized by operation of the operating switch, may move vertically within the lower portion, the drive head is disposed within spiral groves that are disposed within the lower portion, the spiral grooves corresponding to raised spiral teeth disposed on the drive head, and as the drive mechanism is engaged and the shaft of the electric motor rotates causing rotation of the drive head, the auger bit rotates in the same direction as the rotation of the drive mechanism, causing the drive mechanism and the auger bit to move vertically in the lower portion, either in the downward direction or upward direction.

13. The beach umbrella of claim 12 wherein the auger bit, when rotated, extends out of the lower portion or, upon reversal of the electric motor, is withdrawn into the lower portion.

14. A beach umbrella comprising:

a canopy;

a lower portion and an upper portion the upper portion and lower portion further having interior walls;

a battery pack;

the lower portion has a compartment located within the lower portion, the compartment being storage for the battery pack; and the lower portion further comprising a drive mechanism and an auger bit, the drive mechanism comprising an operating switch, an electric motor electrically connected to the battery pack through the operating switch, the electrical motor having a shaft, a drive head mechanically connected to the shaft of the electric motor, the electric motor being electrically reversible through operation of the operating switch, and the auger bit mechanically attached to the drive head, and wherein the electric motor further comprises raised portions that are disposed within vertical grooves formed within the interior wall of the lower portion such that the electric motor, when energized by operation of the operating switch, may move vertically within the lower portion, the drive head is disposed within spiral grooves that are disposed in the lower portion, the spiral grooves corresponding to raised spiral teeth disposed on the drive head, and as the drive mechanism is engaged and the shaft of the electric motor rotates causing rotation of the drive head, the auger bit rotates in the same direction as the rotation of the drive mechanism, causing the drive mechanism and the auger bit to move vertically in the lower portion, either in the downward direction or upward direction, and wherein the auger bit, when rotated, extends out of the lower portion or, upon reversal of the electric motor, is withdrawn into the lower portion.

* * * * *